US006453822B2

(12) United States Patent
Theurer et al.

(10) Patent No.: US 6,453,822 B2
(45) Date of Patent: Sep. 24, 2002

(54) TAMPING MACHINE

(75) Inventors: Josef Theurer, Vienna; Bernhard Lichtberger, Leonding, both of (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 0 days.

(21) Appl. No.: 09/824,384

(22) Filed: Apr. 2, 2001

(30) Foreign Application Priority Data

Apr. 7, 2000 (AT) ..... 272/2000 U

(51) Int. Cl.[7] ..... E07B 27/17
(52) U.S. Cl. ..... 104/12; 104/7.2
(58) Field of Search ..... 104/7.2, 7.3, 10, 104/7.1, 12, 2; 33/1 Q, 287

(56) References Cited

U.S. PATENT DOCUMENTS 3,902,426 A * 9/1975 Plasser et al. ..... 104/8
4,632,037 A * 12/1986 Theurer et al. ..... 104/7.2
4,691,565 A * 9/1987 Theurer ..... 73/146
4,905,604 A * 3/1990 Theurer ..... 104/10
4,947,757 A * 8/1990 Theurer ..... 104/12
5,090,329 A * 2/1992 Theurer ..... 104/7.1
5,379,700 A * 1/1995 Theurer ..... 104/12
6,220,170 B1 * 4/2001 Theurer et al. ..... 104/10
6,311,624 B1 * 11/2001 Theurer et al. ..... 104/2

* cited by examiner

*Primary Examiner*—S. Joseph Morano
*Assistant Examiner*—Frantz F. Jules
(74) *Attorney, Agent, or Firm*—Collard & Roe, P.C.

(57) ABSTRACT

A mobile tamping machine for tamping ballast under a main track comprises a machine frame supported on undercarriages running on the main track for moving the machine frame in an operating direction, the main track defining a track plane, a ballast tamping unit mounted on the machine frame between the undercarriages, a main track lifting and lining unit vertically and transversely adjustably mounted on the machine frame immediately ahead of the ballast tamping unit in the operating direction, a drive for vertically and transversely adjusting the main track lifting and lining unit, an auxiliary lifting unit mounted on the machine frame for lifting a branch track branching off the main track at a track switch, and a common measuring system for controlling lifting of the track switch, the common measuring system including an emitter of a light beam forming a reference line extending parallel to the track plane, the light beam emitter being positioned at a fixed distance from the main track, and a receiver of the light beam recording the reference line, the light beam receiver being positioned at a fixed distance from the branch track.

5 Claims, 2 Drawing Sheets

TAMPING MACHINE

BACKGROUND OF THE INVENTION

Field of the Invention

The present invention relates to a mobile tamping machine for tamping ballast under a main track, which comprises a machine frame supported on undercarriages running on the main track for moving the machine frame in an operating direction, the main track defining a track plane, a ballast tamping unit mounted on the machine frame between the undercarriages, a main track lifting and lining unit vertically and transversely adjustably mounted on the machine frame immediately ahead of the ballast tamping unit in the operating direction, drive means for vertically and transversely adjusting the main track lifting and lining unit, an auxiliary lifting unit mounted on the machine frame for lifting a branch track branching off the main track at a track switch, and a measuring system for controlling lifting of the track switch.

U. S. Pat. No. 4,905,604 discloses a machine of this type. According to the patent, a special reference system is required to control the lifting of the branch track. The references system comprises a measuring axle running on the main track and a measuring axle running of the branch track. The two measuring axles are coupled together by a rod carrying a cross level. This enables an operator remote-controlling the auxiliary branch track lifting unit to conform the lifting of the branch track accurately to that of the main track by monitoring the cross level.

SUMMARY OF THE INVENTION

It is the primary object of this invention to provide a tamping machine of the indicated type which enables an exact conformity between the lifting of the main and branch tracks at a switch to be effected in a simple manner.

This and other objects are accomplished in a machine of the first-described structure according to the invention by providing a common measuring system including an emitter of a light beam forming a reference line extending parallel to the track plane, the light beam emitter being positioned at a fixed distance from the main track, and a receiver of the light beam recording the reference line, the light beam receiver being positioned at a fixed distance from the branch track.

The fixed distance may be zero, if desired, i.e. the light beam emitter and receiver may contact the main and branch tracks, respectively.

Such a common measuring system automatically and accurately coordinates the lifting of the main and branch tracks at the switch. In this way, an accurate and swift track position correction can be effected without any problems even in track switches which have long ties with elastic joints.

BRIEF DESCRIPTION OF THE DRAWING

The above and other objects, advantages and features of the present invention will become more apparent from the following detailed description of certain now preferred embodiments thereof, taken in conjunction with the accompanying drawing wherein.

DETAILED DESCRIPTION OF THE PREFERRED EMBODIMENTS

Figure 1:
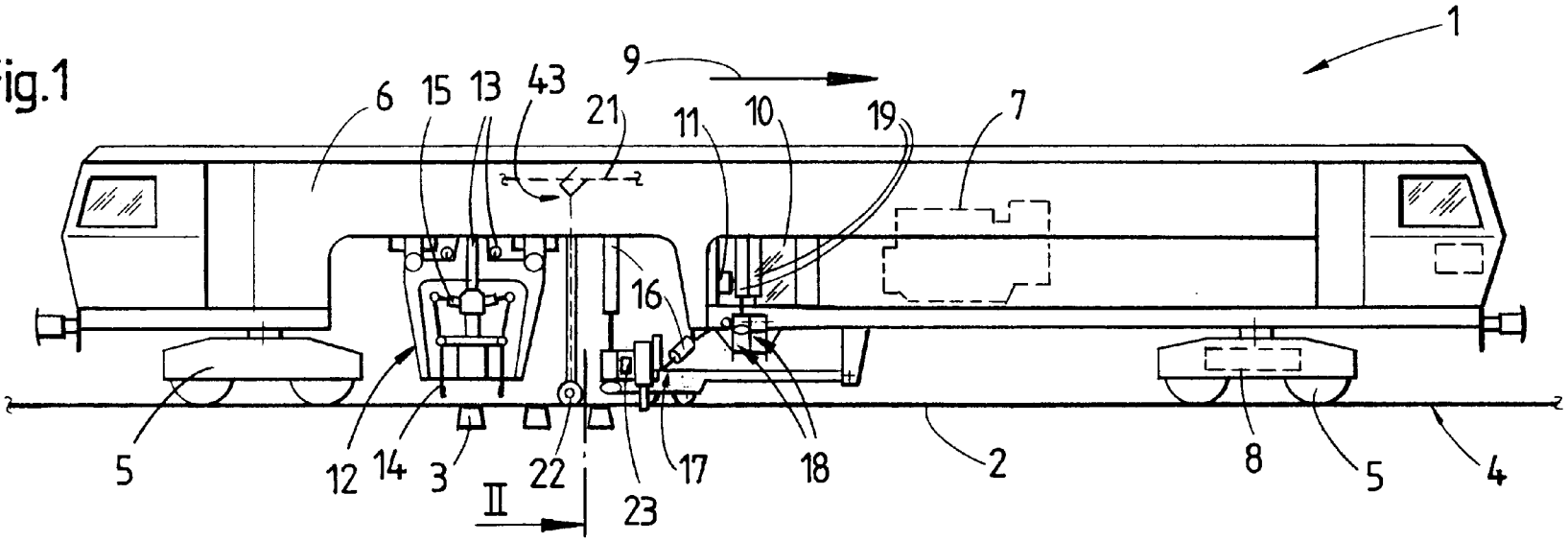
FIG. 1 is a somewhat simplified side elevational view of a tamping machine according to this invention.
Figure 2:
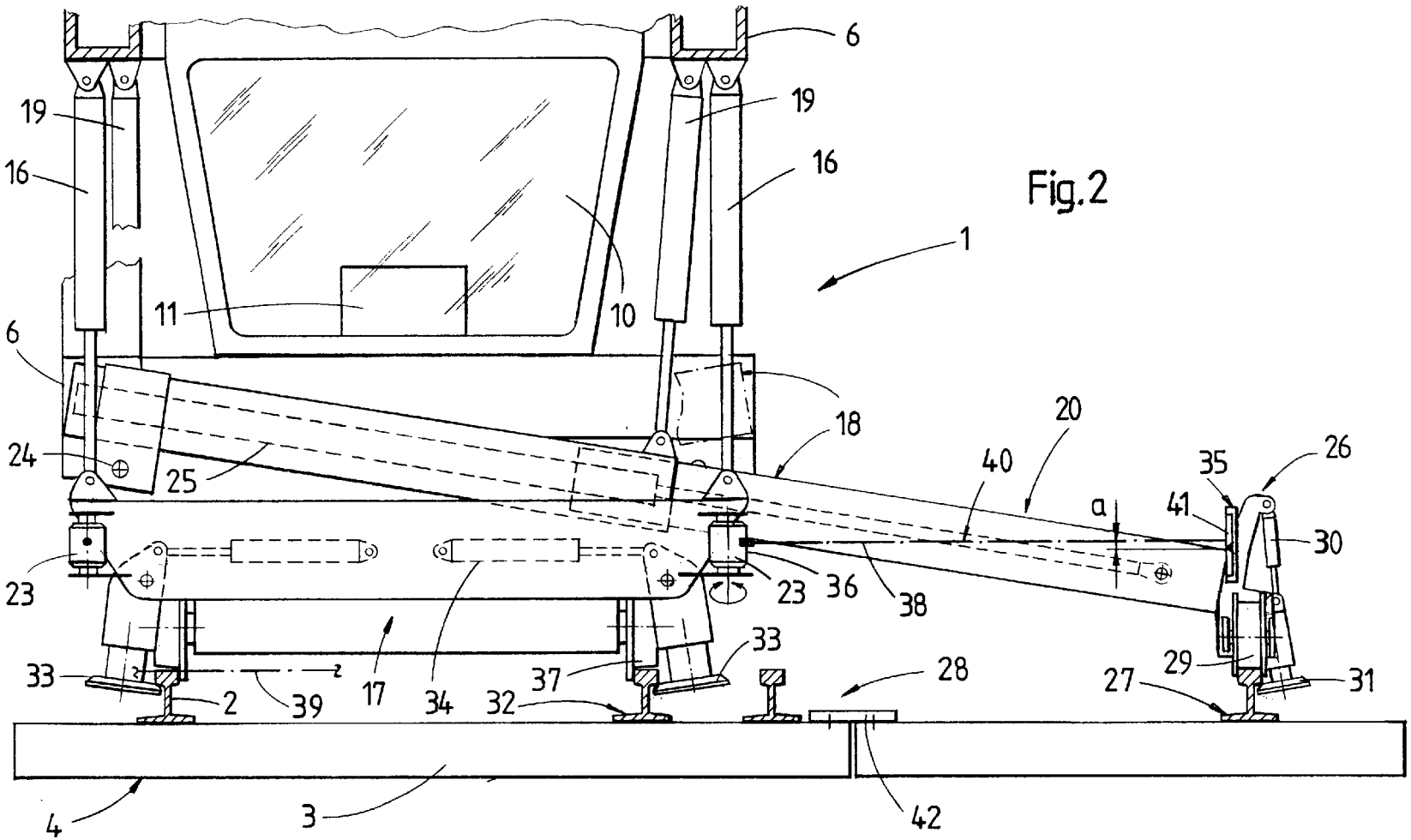
FIG. 2 is an enlarged cross sectional view along line II of FIG. 1.

Referring now to the drawing and first to FIGS. 1 and 2, there is shown mobile tamping machine 1 for tamping ballast under track 4 comprised of rails 2 fastened to ties 3. The illustrated tamping machine comprises machine frame 6 supported on undercarriages 5, 5 running on track 4 for moving machine frame 6 by drive 8 actuated by motor 7 in an operating direction indicated by arrow 9. The track defines track plane 39. Operator's cab 10 houses control 11 for operating the operating devices of the machine.

Ballast tamping unit 12 is mounted on machine frame 6 between undercarriages 5, 5. The ballast tamping unit is a special and conventional ballast tamping unit adapted for use in track switches, and is vertically and transversely adjustable on the machine frame by drives 13. The ballast tamping unit comprises tamping tools 14 which may be moved back and forth in the direction of track 4 by reciprocating drives 15.

Main track lifting and lining unit 17 for leveling main track 32 is vertically and transversely adjustably mounted on machine frame 6 immediately ahead of ballast tamping unit 12 in the operating direction, and drive means 16 vertically and transversely adjust the main track lifting and lining unit. The main track lifting and lining unit runs on the main track and is comprised essentially of flanged rollers 37 running on rails 2 of main track 32 of switch 28 and lifting rollers 33 which are actuated by drives 24 to engage rails 2. Drive means 16 are controlled by main track position reference system 43 which is indicated in FIG. 1 by reference chord 21 engaged by measuring axle 22 running on the main track. All of the heretofore described structure and operation being entirely conventional, they have been only illustrated in a simplified manner.

Two like auxiliary lifting units 18 are mounted on machine frame 6 adjacent main track lifting and lining unit 17 for lifting branch track 27 branching off main track 4 at track switch 28. A respective one of the auxiliary lifting units is mounted on each side of the machine frame for operation on respective branch tracks branching off the main track on respective sides and, for the sake of simplicity, the two auxiliary lifting units are only diagrammatically shown in FIG. 1.

As shown in FIG. 2, one end of each auxiliary lifting unit is linked to machine frame 6 by joint 24 whose axis extends in the direction of the longitudinal extension of the machine frame. The auxiliary lifting unit extends transversely to the longitudinal extension of the machine frame. It is vertically adjustable by drive 19 and is extensible by drive 25. Branch track lifting device 26 is mounted on an end of auxiliary lifting unit 18 opposite to the one end at which joint 24 links the auxiliary lifting unit to machine frame 6. The branch track lifting device is comprised essentially of double-flanged roller 29 rolling along a rail of branch track 27 and lifting roller 31 which engages the branch track rail by operation of drive 30. Such auxiliary lifting units also are conventional.

In the illustrated embodiment, long tie 3 in switch 28, which connects the main and branch tracks, is comprised of two parts, and elastic joint 42 connects the two tie parts to each other.

Measuring system 20 common to main track lifting and lining unit 17 and a respective one of auxiliary lifting units 18 for controlled lifting of track switch 28 includes emitter 23 of a light beam forming reference line 38 extending parallel to track plane 39, and receiver 35 of the light beam recording the reference line. The light beam emitter and receiver are positioned at a fixed distance from the main track and the branch track, respectively, a respective one of light beam emitters 23 being mounted at each side of the machine frame for cooperation with a respective one of the auxiliary lifting units.

In the illustrated embodiment, light beam emitter 23 is rotationally arranged and consists of rotational emitter 36 emitting a sweeping laser beam forming measuring plane 40 defined by reference line 38 and extending parallel to track plane 39, and light beam receiver 35 is a sensor 41 of laser beams.

As shown in FIG. 2, light beam emitter 23 is mounted on main track lifting and lining unit 17, and light beam receiver 35 is mounted on auxiliary lifting unit 18.

Figure 3:
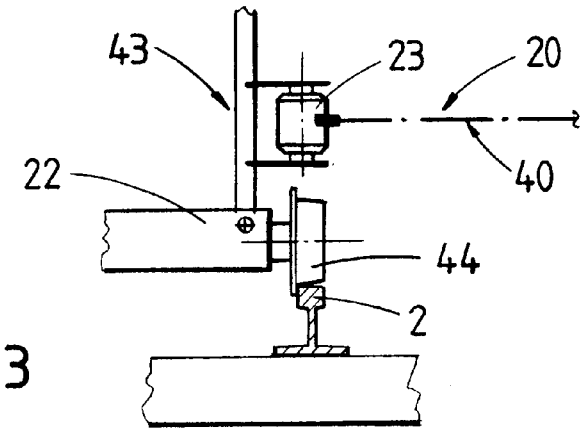
FIG. 3 is a simplified fragmentary end view of a modified embodiment.

In the embodiment illustrated in FIG. 3, light beam emitter 23 is arranged on measuring axle 22 forming part of reference system 43 and supported on rails 2 of main track 32 by flanged rollers 44 between ballast tamping unit 12 and main track lifting and lining unit 17.

The above-described tamping machine is operated in the following manner:

As the tamping machine is moved in the operation direction along track 4, the track position is corrected under the control of reference system 43 to level and/or line the track by actuating leveling and lining unit 17 and by tamping ballast under the corrected track by actuating tamping unit 12. When switch 28 is reached by the machine, a respective one of auxiliary lifting units 18 is extended by actuating drive 25, and lifting device 26 is engaged with a rail of branch track 27. The subsequent correction of the position of track switch 28 follows automatically as drives 16 adjust main track lifting and leveling unit 17, with light beam emitter 23, until the desired track position has been reached.

As the track position correction proceeds by the adjustment of main track leveling and lining unit 17, light beam emitter 23 generates a reference plane 40 parallel to track plane 39, and the emitted light beam activates light beam receiver 35 of reference system 20. This is illustrated in FIG. 2, showing a deviation "a" of reference plane 40 from a zero position, which is registered on receiver 35. Subsequently, control 11 connected to light beam receiver 35 operates branch track lifting drive 19 until reference plane 40 has reached the zero position. At that point, branch track 27 of track switch 28 is positioned exactly in track plane 39 of the main track.

What is claimed is:

1. A mobile tamping machine for tamping ballast under a main track, which comprises (a) a machine frame supported on undercarriages running on the main track for moving the machine frame in an operating direction, the main track defining a track plane, (b) a ballast tamping unit mounted on the machine frame between the undercarriages, (c) a main track lifting and lining unit vertically and transversely adjustably mounted on the machine frame immediately ahead of the ballast tamping unit in the operating direction, (d) drive means for vertically and transversely adjusting the main track lifting and lining unit, (e) a main track position reference system controlling the drive means, (f) an auxiliary lifting unit mounted on the machine frame for lifting a branch track branching off the main track at a track switch, and (g) a common measuring system for controlling lifting of the track switch, the common measuring system including (1) an emitter of a light beam forming a reference line extending parallel to the track plane, the light beam emitter being positioned at a fixed distance from the main track, and (2) a receiver of the light beam recording the reference line, the light beam receiver being positioned at a fixed distance from the branch track.

2. The tamping machine of claim 1, wherein the light beam emitter is rotational and emits a sweeping laser beam forming a measuring plane defined by the reference line and extending parallel to the track plane, and the light beam receiver is a sensor of the laser beam.

3. The tamping machine of claim 1, wherein the light beam emitter is mounted on the main track lifting and lining unit, and the light beam receiver is mounted on the auxiliary lifting unit.

4. The tamping machine of claim 1, wherein the auxiliary lifting unit includes a branch track lifting drive, and further comprising a control connected to the light beam receiver for operating the lifting drive.

5. A mobile tamping machine for tamping ballast under a main track, which comprises (a) a machine frame supported on undercarriages running on the main track for moving the machine frame in an operating direction, the main track defining a track plane, (b) a ballast tamping unit mounted on the machine frame between the undercarriages, (c) a main track lifting and lining unit vertically and transversely adjustably mounted on the machine frame immediately ahead of the ballast tamping unit in the operating direction, (d) drive means for vertically and transversely adjusting the main track lifting and lining unit, (e) a main track position reference system controlling the drive means, (f) an auxiliary lifting unit mounted on the machine frame for lifting a branch track branching off the main track at a track switch, (g) a common measuring system for controlling lifting of the track switch, the common measuring system including (1) an emitter of a light beam forming a reference line extending parallel to the track plane, the light beam emitter being positioned at a fixed distance from the main track, and (2) a receiver of the light beam recording the reference line, the light beam receiver being positioned at a fixed distance from the branch track, and (h) a measuring axle supported on the main track by flanged rollers between the ballast tamping unit and the main track lifting and lining unit, the light beam emitter being arranged on the measuring axle.

* * * * *